United States Patent [19]

Stahlecker et al.

[11] Patent Number: 4,858,275

[45] Date of Patent: Aug. 22, 1989

[54] OPENING ROLLER CONSTRUCTION FOR OPEN END SPINNING MACHINE AND THE LIKE

[75] Inventors: Fritz Stahlecker, Josef-Neidhart-Strasse 18, 7347 Bad Überkingen; Gerd Stahlecker, Eislingen/Fils, both of Fed. Rep. of Germany

[73] Assignees: Fritz Stahlecker; Hans Stahlecker, both of Fed. Rep. of Germany

[21] Appl. No.: 237,760

[22] Filed: Aug. 29, 1988

[30] Foreign Application Priority Data

Sep. 10, 1987 [DE] Fed. Rep. of Germany ..... 3730295

[51] Int. Cl.[4] ..... D01E 15/14; D01H 7/895

[52] U.S. Cl. ..... 19/97; 19/112; 57/408

[58] Field of Search ..... 57/408; 19/97, 112, 19/105, 107, 144

[56] References Cited

U.S. PATENT DOCUMENTS

| | | | |
|---|---|---|---|
| 3,750,382 | 8/1973 | Minami | 57/408 X |
| 4,044,427 | 8/1977 | Ankrom et al. | 19/97 |
| 4,272,865 | 6/1981 | Schmolke | 19/97 |
| 4,291,437 | 9/1981 | Yoshizawa et al. | 57/408 X |
| 4,352,224 | 10/1982 | Grimshaw et al. | 19/97 |
| 4,435,953 | 3/1984 | Schmid et al. | 57/408 |
| 4,606,095 | 8/1986 | Egerer | 19/112 |
| 4,646,389 | 3/1987 | Stahlecker et al. | 19/97 |

*Primary Examiner*—Donald Watkins
*Attorney, Agent, or Firm*—Barnes & Thornburg

[57] ABSTRACT

In the case of a mounting or ring fitting for an opening roller for open end spinning machines and the like, it is provided that the tooth tips are chamfered and form cutting edges which extend essentially in the travel direction of the teeth.

13 Claims, 2 Drawing Sheets

OPENING ROLLER CONSTRUCTION FOR OPEN END SPINNING MACHINE AND THE LIKE

BACKGROUND AND SUMMARY OF THE INVENTION

The invention relates to an opening roller construction having a plurality of teeth, each tooth having a tooth throat, a tooth face, a back, and lateral profiles between the tooth face and the back, and a vertical angle of no more than 30° and a front angle of at least 15° being provided A toothed fitting for an opening roller of the initially mentioned type is known from German Published Application No. 34 39 664 (see also related commonly owned pending U.S. application Ser. No. 191,402, filed May 9, 1988 as a Continuation-in-Part of U.S. Application Ser. No. 793,122, filed Oct. 30, 1985). In this case, the teeth are produced in that they are machined out of solid material by the working-in of grooves extending essentially in axial direction and of grooves extending essentially in circumferential direction. By means of this method of production, it is possible to adapt the shape of the teeth to specific tasks and particularly also to the fiber material to be processed.

Other commonly assigned patents and patent applications which relate to opening roller constructions include (i) pending U.S. Application Ser. No. 196,688, which is a Continuation-in-Part of U.S. Application Ser. No. 088,973, filed Aug. 24, 1987, which is in turn a Continuation of Application Ser. No. 731,272, filed May 7, 1985; (ii) U.S. Pat. 4,646,389; and (iii) U.S. Pat. No. 4,715,777.

See also commonly assigned U.S. Pat. Application Ser. No. 237,330, filed Aug. 29, 1988, based on German Patent Application No. P 37 30 297.3, filed Sept. 10, 1978 in Germany.

An object of the invention is to provide a toothed fitting of the initially mentioned type with improved penetration into the fiber material to be opened up, which fiber material is offered in the manner of a fiber beard to the opening roller equipped with the toothed fitting.

This object is achieved in that the tooth tips are chamfered and form cutting edges which extend essentially in the travel direction of the teeth.

Tooth tips that are constructed in this manner penetrate more easily into the fiber material which consists essentially of fibers that are aligned in parallel to one another in the travel direction of the teeth. As a result, it is achieved that the tooth tips, on the one hand, cause little damage when they penetrate into the fiber material, and, on the other hand, also do not press the fiber material out of the area of the toothed fitting.

In a further development of preferred embodiments of the invention, it is provided that the lateral profiles of the teeth, approximately in the area of the last quarter of their radial height, have areas that are chamfered in the manner of cutting edges. Tooth shapes of this type can be ground in a manner that is similar to methods used in the case of saw blades or milling tools. For reasons of stability, it is advantageous according to especially preferred embodiments for the areas of the lateral profiles that are chamfered in the manner of cutting edges to enclose between one another an angle of approximately 35° to 50 ° As a result, a compromise can be achieved between the chamfering in the manner of cutting edges and sufficient stability.

In a further development of preferred embodiments of the invention, it is provided that the cutting edges, have a width transversely to the travel direction, of approximately 0.1 mm. It is also provided that the cutting edges, in the travel direction, have a length of at least 2 mm. By means of teeth of this type, which have almost the shape of needles, a good opening-up of the fiber material can be achieved.

In a further development of preferred embodiments of the invention, it is provided that the teeth are worked out of the exterior surface of a ring by the machining in of grooves extending essentially in axial direction and of grooves extending essentially in circumferential direction, in which case the grooves extending essentially in circumferential direction are deeper than the grooves extending essentially in axial direction. As a result, recessed lanes extending essentially in circumferential direction can be created between the teeth which permit an advantageous conveying of the combed-out fibers. In this case, the grooves extending in circumferential direction are preferably ⅓deeper than the other grooves.

In a further development of preferred embodiments of the invention, it is provided that at least the teeth are nitrided. This nitriding has the advantage that a relatively soft steel material an be used for the production of the teeth which, after the nitriding process —for example, in contrast to case hardening, can be used without any refinishing because no drafts or structural changes or the like occur at the surface. An additional tempering of the tooth core is possible for a better carrying of the nitrided layer. The surface quality of the nitrided layer has a positive effect on the opening-up of the fibers.

Other objects, advantages and novel features of the present invention will become apparent from the following detailed description of the invention when considered in conjunction with the accompanying drawings.

DETAILED DESCRIPTION OF THE DRAWINGS

Figure 1:
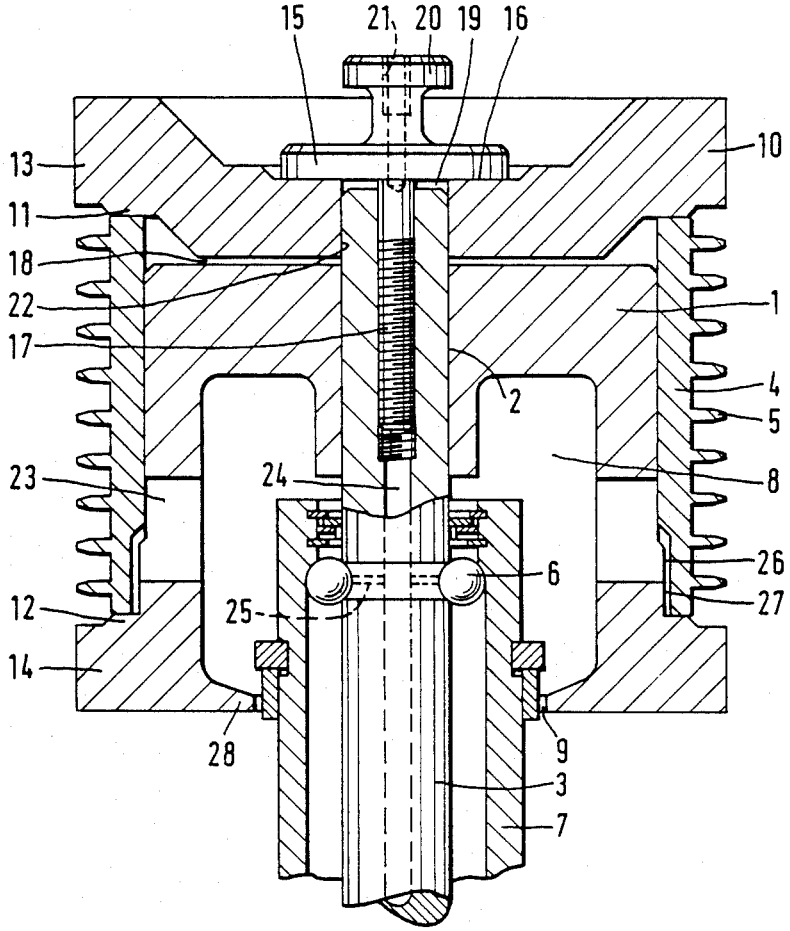
FIG. 1 is an axial sectional view of an opening roller having a mounting or toothed fitting constructed according to the a preferred embodiment of invention.

The opening roller shown in FIG. 1 is mounted on a shaft 3 which, by means of two bearings, is disposed in a bearing housing 7, only one bearing 6 of the two bearings being shown. The end of the shaft 3 that is not shown projects beyond the bearing housing 7 and is equipped with a driving wharve. On the end of the shaft 3 that faces away from the driving wharve, the actual opening roller is arranged.

A base body 1 is slid onto the shaft 3 by means of a press fit 2. If necessary, the axial position of the base body 1 is secured by a collar or a retaining ring or the like in the direction of the bearing housing 7. The base body 1 has a cylindrical outer surface onto which a ring mounting or fitting 4 is slid with an easily releasable sliding fit. The ring mounting 4 is equipped with a plurality of teeth 5. The teeth 5 are machined in the ring mounting 4 by means of turning and grinding and are therefore produced in one piece with the ring mounting 4.

After the base body 1 is slid on, the ring mounting 4, with its front face, rests against a flange 12 of the base body 1. The opposite front face of the ring mounting 4 which projects over the base body 1, in the axial direction is braced by means of a flange 11 of a bracing disk 10 with respect to the flange 12.

The bracing disk 10 has a centric bore 22 by means of which it is slid with a light sliding fit onto the shaft 3 projecting beyond the base body 1 toward the outside. The axial securing of the bracing disk 10 takes place by means of a screw 17 which is screwed into a centric threaded bore of the shaft 3. The screw 17 is equipped with a head 20 which has a flange 15 which supports itself against a radial bracing surface of the bracing disk 10. This flange 15 is adjoined by a gripping edge, via a ring groove towards its outside end. The head 20 of the screw 17 has a recess 21 in its center, such as a hexagonal cross-section recess which is used as a working surface for a tool by means of which the screw 17 can be turned.

As also shown in FIG. 1, the length of the ring mounting 4 which projects axially beyond the base body 1, and the thickness of the bracing disk 10 are coordinated with one another such that, in the assembled condition, a gap 18 remains in each case between the bracing disk 10 and the base body 1 as well as a gap 19 between the flange 15 and the end of the shaft 3.

The bracing disk 10 has an approximately saucer-type shape by means of which it is achieved that the area of the flange 11 is somewhat flexible in axial direction with respect to the center area of the bracing disk, i.e., in the area of the bracing surface 16, so that the bracing disk 10 is elastically flexible in the manner of a saucer spring. As a result of this saucer-type construction, the head 20 of the screw 17 is arranged within the bracing disk 10 so that it is at least Partially covered.

The ring mounting 4 is not equipped with collars or the like, which in particular is the result of the fact that the teeth 5 of the ring mounting 4 were made by being worked out of the full material in one piece with the ring mounting 4. In order to protect the teeth 5 from being damaged, the flange 12 of the base body 1 as well as the flange 11 of the bracing disk 10, are extended in the radial direction to at least the area of the tips of the teeth 5 by means of projections 13 and 14. As shown, these projections 13 and 14 are in each case set back with respect to the flange surfaces of the flanges 11 and 12 which clamp in the front faces of the ring mounting 4.

In order to ensure that the ring mounting 4 can be installed only in the correct position, the interior surface of the ring mounting 4 is provided with a ring-groove-type recess 26 in the area of the front face facing the flange 12 of the base body 1. A collar-type elevation 27 of the base body 1 is assigned to this recess 26, this collar-type elevation 27, in axial direction, being slightly shorter than the recess 26 and the height of this collar-type elevation 27 being less than the radial depth of the recess 26 so that the ring mounting 4 and the base body 1 do not touch in the area of the recess 26.

The base body 1 is cup-shaped and, while leaving a hollow space 8, reaches over the end of the bearing housing 7 facing the base body 1. The base body 1 is equipped with a collar 28 which forms a sealing gap 9 together with the bearing housing 7 or a sealing insert mounted on it. In order to be able to clean the hollow space 8, the base body 1 is provided with radial bores 23 which, during the operation, are covered by the ring mounting 4. For cleaning dirt or fiber residues or the like out of the hollow space 8, the ring mounting 4, after the bracing ring 10 is taken off, can be shifted axially to such an extent that the bores 23 become accessible to a cleaning tool, particularly a compressed-air nozzle.

It is also provided that the threaded bore receiving the screw 17 is extended in the axial direction of the shaft 3 and extends to the two bearings 6. In the area of these bearings 6, lubricant ducts 25 branch off this axial bore 24, so that, after the screw 17 is unscrewed, lubricant can be supplied to the bearings 6.

Figure 2:
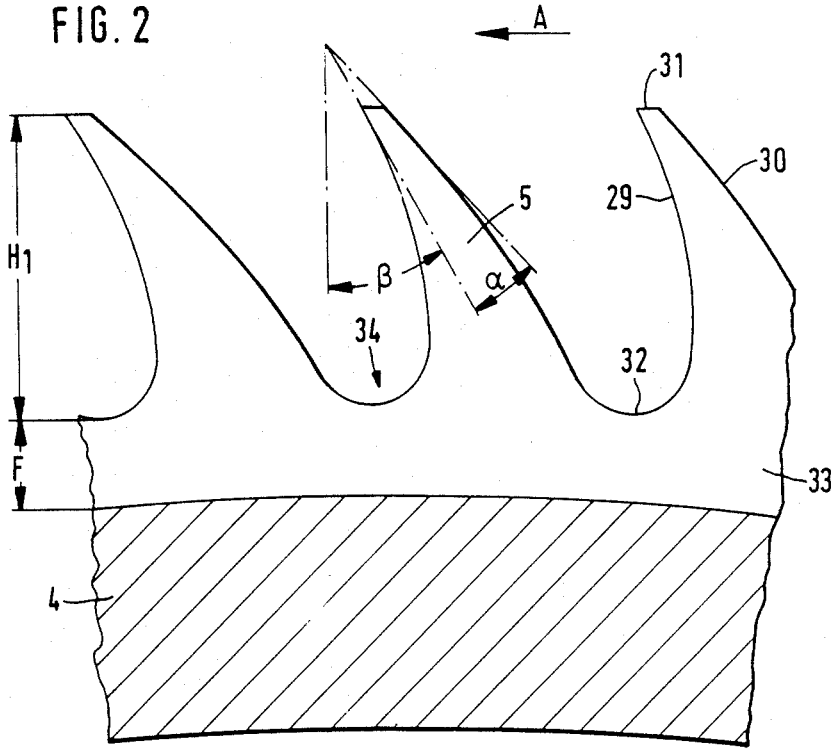
FIG. 2 is an enlarged partial lateral view of the teeth of the mounting of the opening roller of FIG. 1.

The teeth 5 of the ring mounting 4, which in FIG. 2 are shown in a very enlarged scale, have a tooth face 29 and a back 30. The tooth face 29 points in the travel direction (A) of the ring mounting 4. The tooth face 29 and the back 30 enclose a vertical angle ($\alpha$) between one another which is maximally 30° The tooth face 29, with respect to a radial line, forms a front angle ($\beta$) that is at least 15° so that relatively pointed needle-type teeth 5 are created. The tooth face 29 is concavely curved in a crescent shape and, via a distinctive rounding 32, merges into the essentially straight back 30 of the preceding tooth 5. Between the tooth face 29 and the back 30, the teeth 5 have lateral profiles 37, 38 which, in the area of their last quarter, have areas 39, 40 that are chamfered in the manner of cutting edges. The lateral profiles 37, 38 extend approximately in radial planes and have no more than a relatively slight inclination of only a few degrees with respect to one another. The areas 39, 40 that were chamfered in the manner of cutting edges, however, extend toward one another at an acute angle and enclose an angle of between 35° and 50° between one another, preferably in a range of 40° to 45° The tip 31 of the teeth 5 is therefore developed in the manner of a cutting edge 41 which extends essentially in the travel direction (A). The cutting edge 41, transversely to the moving direction (A), has a width (W in FIG. 3) of approximately 0.1 mm.

As shown in FIG. 2, the tips 31 of the teeth 5 are slightly smoothed down so that the cutting edge 41 has a longitudinal course (L in FIG. 2) in circumferential direction which is in the range of 2 mm.

Figure 3:
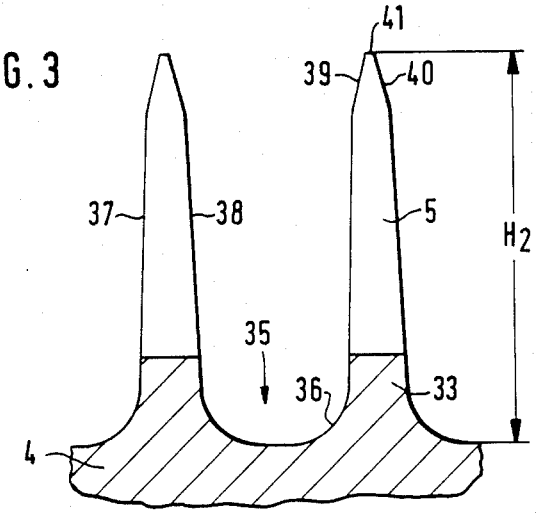
FIG. 3 is an enlarged partial axial sectional view of the teeth of the opening roller of FIG. 1.

In the described shape, the teeth 5 are worked on or machined out of the outer surface of the ring mounting that was first made from a compact material. For this purpose, by means of turning and grinding, grooves 34 are machined in that extend essentially in the axial direction, and grooves 35 are machined in that extend essentially in the circumferential direction. Grooves 35 extend in one or several spirals. As shown in FIGS. 2 and 3, grooves 35 are worked deeper into the ring mounting 4 than grooves 34. As a result, lanes are created between the teeth 5 which extend essentially in the circumferential direction and, with a distinctive rounding 36, merge into the lateral profiles 38 of the teeth 5. A comparison of FIGS. 2 and 3 will show that the tooth height (H1) created by the grooves 34, i.e., the height of the tooth face 29 and of the tooth back 30, are by an amount (F) smaller than the tooth height (H2) in the area of the lateral profiles 37, 38. Thus, massive tooth throats 33 are created in the lower area of the teeth 5. Height (H2) should be at least 1.35 times height (H1), i.e., grooves 35 are by approximately $\frac{1}{3}$deeper than grooves 34.

The ring mounting 4 is subjected to a surface treatment at least in the area of the teeth 5, whereby wear is reduced. Nitriding is particularly suitable for this purpose.

Although the present invention has been described and illustrated in detail, it is to be clearly understood that the same is by way of illustration and example only, and is not to be taken by way of limitation. The spirit and scope of the Present invention are to be limited only by the terms of the appended claims.

We claim:

1. A mounting for an opening roller having a plurality of teeth, each tooth having a tooth throat, a tooth face, a tooth back, and lateral profiles between the tooth face and the tooth back, wherein the tooth face and tooth back define an angle of no more than 30° between one another, wherein the tooth face defines an angle of at least 15° with an axial plane extending from a roller rotational axis when in an operating position, and wherein outer radial tips of the teeth are chamfered and form cutting edges which extend essentially in the travel direction (A) of the teeth.

2. A mounting according to claim 1, wherein the lateral profiles of the teeth which extend along the axial extent of the mounting, have areas at their radial outer ends that are chamfered in the manner of cutting edges approximately in the area of the last quarter of the radial height of the teeth.

3. A mounting according to claim 1, wherein the lateral profiles which extend along the axial extent of the mounting have areas at their radial outer ends that are chamfered in the manner of cutting edges and which enclose an angle of approximately 35° to 50° between one another.

4. A mounting according to claim 3, wherein said chamfered areas extend only over approximately the outermost fourth of the radial length of the teeth.

5. A mounting according to claim 1, wherein the cutting edges have a width transversely to the travel direction (A) of approximately 0.1 mm.

6. A mounting according to claim 1, wherein the cutting edges have a length of at least 2 mm in the travel direction (A) of the teeth.

7. A mounting according to claim 5, wherein the cutting edges have a length of at least 2 mm in the travel direction (A) of the teeth.

8. A mounting according to claim 1, wherein the teeth 5 are machined out of the outer surface o a ring by the machining in of grooves extending essentially in the axial direction and of grooves extending essentially in the circumferential direction.

9. A mounting according to claim 8, wherein the grooves extending essentially in the circumferential direction are deeper than the grooves extending essentially in the axial direction.

10. A mounting according to claim 1, wherein at least the teeth are nitrided.

11. A mounting according to claim 8, wherein at least the teeth are nitrided.

12. A mounting according to claim 7, wherein the teeth are machined out of the outer surface of a ring by the machining in of grooves extending essentially in the axial direction and of grooves extending essentially in the circumferential direction.

13. A mounting according to claim 12, wherein at least the teeth are nitrided.

* * * * *